US005097429A

United States Patent [19]

Wood et al.

[11] Patent Number: 5,097,429

[45] Date of Patent: Mar. 17, 1992

[54] PROGRAMMABLE EVENT REMINDER APPARATUS

[76] Inventors: Marc B. Wood, 3430 Country Square Dr., No. 724, Carrollton, Tex. 75006; Fred K. Beckhusen, 505 White Oak, Allen, Tex. 75002; Michael D. Masterton, 13200 Bristlecone Way 41, Germantown, Md. 20874

[21] Appl. No.: 513,436

[22] Filed: Apr. 23, 1990

[51] Int. Cl.[5] ..... G04B 47/00

[52] U.S. Cl. ..... 364/569; 368/10

[58] Field of Search ..... 364/569, 413.02; 368/247, 246, 109, 113, 70, 10; 221/2

[56] References Cited

U.S. PATENT DOCUMENTS

| | | | |
|---|---|---|---|
| 4,216,649 | 8/1980 | Ichikawa et al. | 368/109 |
| 4,318,181 | 3/1982 | Kawakami et al. | 364/569 |
| 4,367,051 | 1/1983 | Inoue | 368/111 |
| 4,419,016 | 12/1983 | Zoltan | 368/10 |
| 4,490,711 | 12/1984 | Johnston | 368/246 X |
| 4,588,303 | 5/1986 | Wirtschafter et al. | 368/10 |
| 4,612,623 | 9/1986 | Bazarnik | 364/569 |
| 4,677,541 | 6/1987 | Singhi | 364/569 X |
| 4,682,299 | 7/1987 | McIntosh et al. | 364/569 |
| 4,712,923 | 12/1987 | Martin | 368/10 |

*Primary Examiner*—Parshotam S. Lall
*Assistant Examiner*—S. A. Melnick
*Attorney, Agent, or Firm*—W. Kirk McCord

[57] ABSTRACT

A programmable event reminder apparatus is housed in a "pocket-sized" casing and includes a microcomputer for processing selected parameters representing a plurality of events and the times at which the events are scheduled to occur. The microcomputer keeps track of the actual time and generates an alarm signal at the time that each of the programmed events is scheduled to occur. The apparatus includes a visual display, whereby the particular event and the scheduled time of the event are displayed when the alarm signal is generated. A current alarm signal will continue until it is disabled by the user. The alarm signals corresponding to subsequently scheduled events will be at least temporarily disabled until the current alarm signal is disabled by the user, such that the user will not be reminded of subsequent events until the current alarm signal is acknowledged by the user. The apparatus further includes user-controllable switches for entering the selected parameters and for controlling the apparatus to display selected information relating to the data programmed into the apparatus. For example, the user can call up on the display the time parameters relating to a particular event in chronological sequence, which gives the user a quick indication of how the apparatus has been previously programmed. The user can also remind himself of when the next event is scheduled to occur by displaying the next event and the scheduled time thereof. The event reminder apparatus according to the present invention is particularly well-suited for use as a medication prompting device to alert the user that a particular medication is due to be taken at a particular time.

11 Claims, 7 Drawing Sheets

PROGRAMMABLE EVENT REMINDER APPARATUS

FIELD OF INVENTION

This invention relates generally to electronic timing apparatus and in particular to electronic timing apparatus which is user-programmable for reminding the user when a particular event is scheduled to occur.

BACKGROUND OF THE INVENTION

Electronic timing apparatus have various applications. One such application is to keep track of the times when prescribed medication is due to be taken and to prompt the user when it is time to take the medication. It is difficult for many persons, particular elderly persons, to keep track of the times when their medication is due to be taken, particularly when multiple medications are being taken concurrently. It is important that medications be taken at the prescribed times. Otherwise, the medications may not be beneficial to the patient's health and in fact may even be harmful to the patient.

DESCRIPTION OF THE PRIOR ART

Medication prompting apparatus of various types are known in the art. The apparatus typically include timekeeping means for keeping track of elapsed time and memory means for storing a predetermined time interval between successive doses of the medication. When the elapsed time equals the prescribed time interval, a visual and/or an audible alarm will alert the user to the fact that his medication is due. The alarm will continue to be activated until the user takes the medication or otherwise disables the alarm.

Medication prompting apparatus may be user-programmable or, alternatively, may be programmed by a physician or pharmacist from a remote location. The prompting apparatus may be incorporated into the medication container or attached directly thereto. Prior art medication prompting apparatus are disclosed in U.S. Pat. Nos. 4,361,408; 4,419,016; 4,448,541; 4,504,153; 4,526,474; and 4,660,991. Although many of such prior art apparatus are user-programmable, they are not well-suited for keeping track of multiple types of medication, particularly when the medication is to be taken at irregular intervals.

OBJECTS OF THE INVENTION

It is therefore the principal object of the present invention to provide an improved event reminder apparatus.

Another object of the invention is to provide an improved apparatus for prompting a user to take medication at prescribed times.

Yet another object of the invention is to provide a medication prompting apparatus which is user-programmable for keeping track of multiple medications and for prompting the user to take the medications at the prescribed time intervals.

A further object of the invention is to provide a medication prompting apparatus for keeping track of medication to be taken at irregular time intervals and for alerting the user at the prescribed times.

SUMMARY OF THE INVENTION

These and other objects are accomplished in accordance with the present invention wherein a programmable event reminder apparatus includes user-controllable input means for entering selected parameters corresponding to a particular event and a time at which the particular event is scheduled to occur; memory means for storing the selected parameters; timekeeping means for keeping track of elapsed time; and means for generating an alarm signal identifying the particular event and the scheduled time of the event, when the actual time corresponds to a time at which the particular event is scheduled to occur. In accordance with one feature of the invention, the apparatus is programmable to keep track of a plurality of discrete events, each of which can be scheduled at a plurality of discrete times.

In one embodiment, the apparatus includes display means for visually identifying a particular event and displaying the scheduled time of the event when the alarm signal is generated. In another embodiment, user-controllable means is provided for disabling the alarm signal. In yet another embodiment, the display means is user-controllable for selecting data to be displayed. The scheduled times of a selected event can be displayed in chronological sequence to allow the user to review the scheduled times which have been previously programmed for that event. The display means is also user-controllable for indicating the next scheduled event and the time of the next scheduled event, so that the user will be forewarned of the next event.

In accordance with another feature of the invention, means is provided for at least temporarily disabling the alarm signals associated with subsequent events until a current alarm signal has been disabled by the user. Therefore, the apparatus will not alert the user that a particular event is scheduled to occur until the user has acknowledged a previously scheduled event by disabling the alarm signal corresponding to the previously scheduled event. This feature is particularly useful when the apparatus has been programmed to alert the user that particular medications are due to be taken at certain times because of the potential harm to the user if his medication is taken out of sequence.

In the preferred embodiment, the apparatus includes processing means responsive to the selected parameters entered by the user for keeping track of the day of the week and the time of day and for controlling a liquid crystal display and a piezoelectric transducer to generate respective visual and audible alarm signals when the actual time corresponds to the scheduled time for a particular event. The input means includes a first switch for entering selected event parameters, a second switch for entering selected time parameters and a third switch for controlling the mode of operation of the apparatus. By operating the three switches, the user can program the apparatus to keep track of the current day of the week and time of day and to store information relating to a plurality of discrete events and the scheduled times for each event. The user can program the apparatus to display previously programmed information, to allow the user to determine whether the previously programmed information is still applicable.

The event reminder apparatus according to the present invention is particularly well-suited for use as a medication prompting apparatus, whereby the user is alerted that a particular medication is due to be taken at a particular time. The apparatus is programmable in substantially the same manner as a digital timepiece, such as a watch or clock. Because most people are familiar with this procedure, programming the apparatus is a relatively simple matter which is within the capability of even those who are aged or infirm.

BRIEF DESCRIPTION OF THE DRAWINGS

Other objects and advantages of the invention will be apparent from the detailed description and claims when read in conjunction with the accompanying drawings wherein:

DETAILED DESCRIPTION OF THE PREFERRED EMBODIMENT

In the description which follows, like parts are marked throughout the specification and drawings, respectively. The drawings are not necessarily to scale and in some instances proportions have been exaggerated in order to more clearly depict certain features of the invention.

Figure 1:
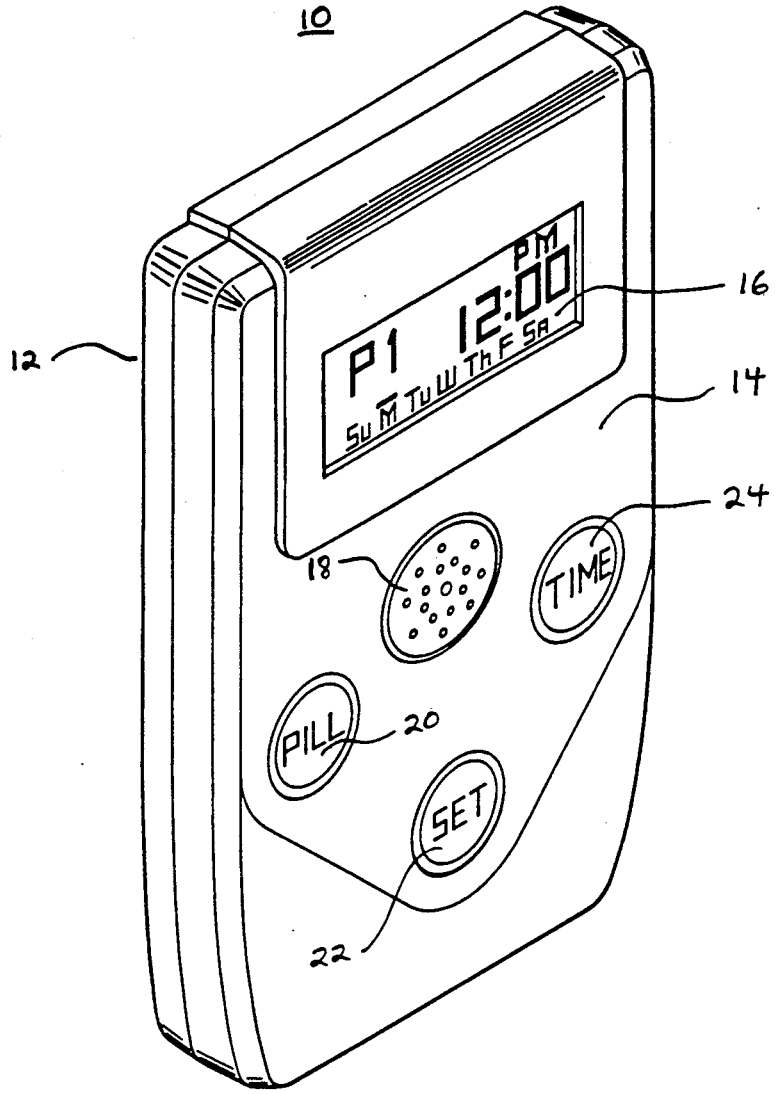
FIG. 1 is a perspective view of a programmable event reminder apparatus, according to the present invention.

Referring to FIG. 1, an electronic event reminder apparatus 10 is housed in a "pocket-sized" casing 12. Disposed on a front face 14 of casing 12 is a digital display 16, a transducer 18 for emitting an audible alarm and three buttons 20, 22 and 24 for inputting time and event information into apparatus 10. Display 16 is preferably a static or direct drive liquid crystal display of the type manufactured and sold by Vikay, Inc., under part no. T1065. Transducer 18 is preferably a piezoelectric transducer manufactured and sold by Murata Erie under Model No. 7-BB-20-6. Buttons 20, 22 and 24 are connected to respective electrical switches for inputting event and time information. Button 20 hereinafter will be referred to as the "pill button", because when apparatus 10 is used to alert or prompt a user to take particular medication at certain times, button 20 is used to program the particular medication into apparatus 10. Buttons 22 and 24 hereinafter will be referred to as the "set button" and the "time button", respectively. Buttons 22 and 24 are used to program apparatus 10 for the various times at which the medications are due to be taken and to enter day of the week and time of day information. Set button 22 and time button 24 operate in substantially the same manner as in a conventional digital timekeeping apparatus, as will be described in greater detail hereinafter.

Figure 2:
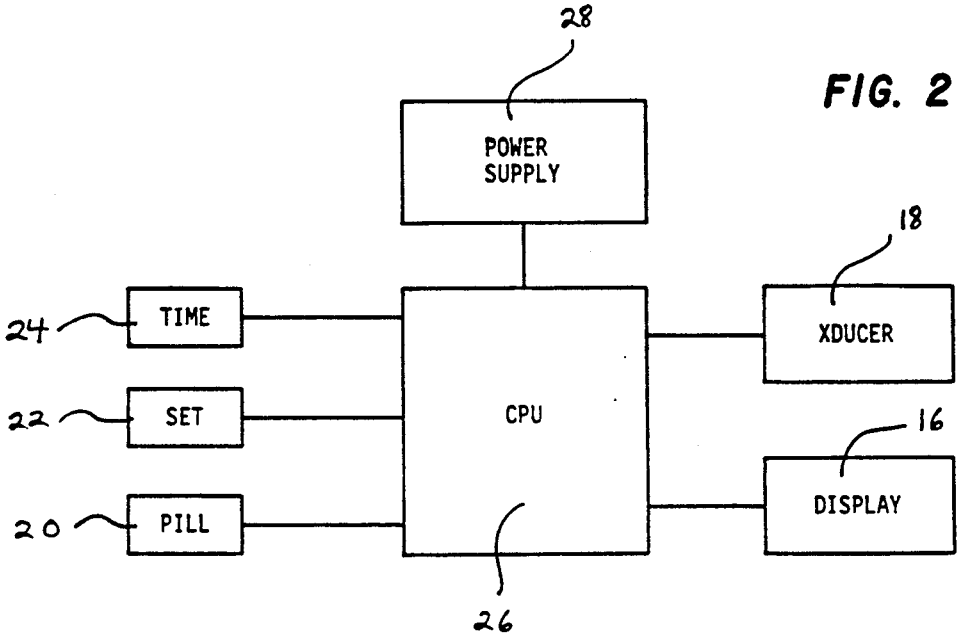
FIG. 2 is a block diagram of the major components of the event reminder apparatus of FIG. 1.

Referring also to FIG. 2, apparatus 10 includes a central processing unit (CPU) 26, which preferably includes a random access memory (RAM) for storing data entered into apparatus 10 via buttons 20, 22 and 24 and a read only memory (ROM) having a permanent set of instructions for controlling the operation of CPU 26. CPU 26 further includes liquid crystal display driver circuitry and input/output circuitry for communicating with and controlling liquid crystal display 16 and transducer 18. CPU 26 is preferably a microcomputer of the type manufactured and sold by NEC under Part No. uPD7503. A DC power supply 28, such as a battery, is housed in casing 12 for operating CPU 26. The power supply voltage may vary from a minimum of 2.0 volts to a maximum 6.0 volts, with the typical voltage being approximately 3.0 volts. CPU 26 should have RAM space of at least 224×4 bytes and ROM space of at least 4K bytes.

Apparatus 10 is user-programmable by means of buttons 20, 22 and 24. Each time the user presses one of the buttons 20, 22 or 24, a corresponding switch is closed and CPU 26 will detect the switch closure. As a safeguard against inadvertent activation of buttons 20, 22 and 24, CPU 26 will delay approximately 31.25 milliseconds after detecting the corresponding switches 20, 22 or 24 in either a closed or open position before determining the status of the corresponding switch 20, 22 or 24. For example, if CPU 26 reads switch 20 as being closed, it will delay the aforementioned 31.25 milliseconds and read switch 20 again. If switch 20 is still closed after the second reading, then CPU 26 will set a flag in software indicating that switch 20 is in fact closed. The same procedure holds true if switch 20, 22 or 24 is detected in a open condition. CPU 26 will delay the aforementioned 31.25 milliseconds and then read the corresponding switch 20, 22 or 24 again. If the corresponding switch 20, 22 or 24 is still in the open condition, then CPU 26 will set a flag in software indicating that the corresponding switch 20, 22 or 24 is in the open condition. In this manner, CPU 26 will automatically provide for "debouncing" of switches 20, 22 and 24, such that each switch 20, 22 and 24 must remain in a particular condition (i.e., either closed or open) for more than the predetermined delay time (i.e., 31.25 milliseconds) before CPU 26 will respond to the input signal represented by the condition of the corresponding switch 20, 22 or 24. Furthermore, each time button 20, 22 or 24 is pressed, transducer 18 will emit an audible "click" to let the user know that he or she has pressed one of the buttons 20, 22 and 24.

Figure 3A:
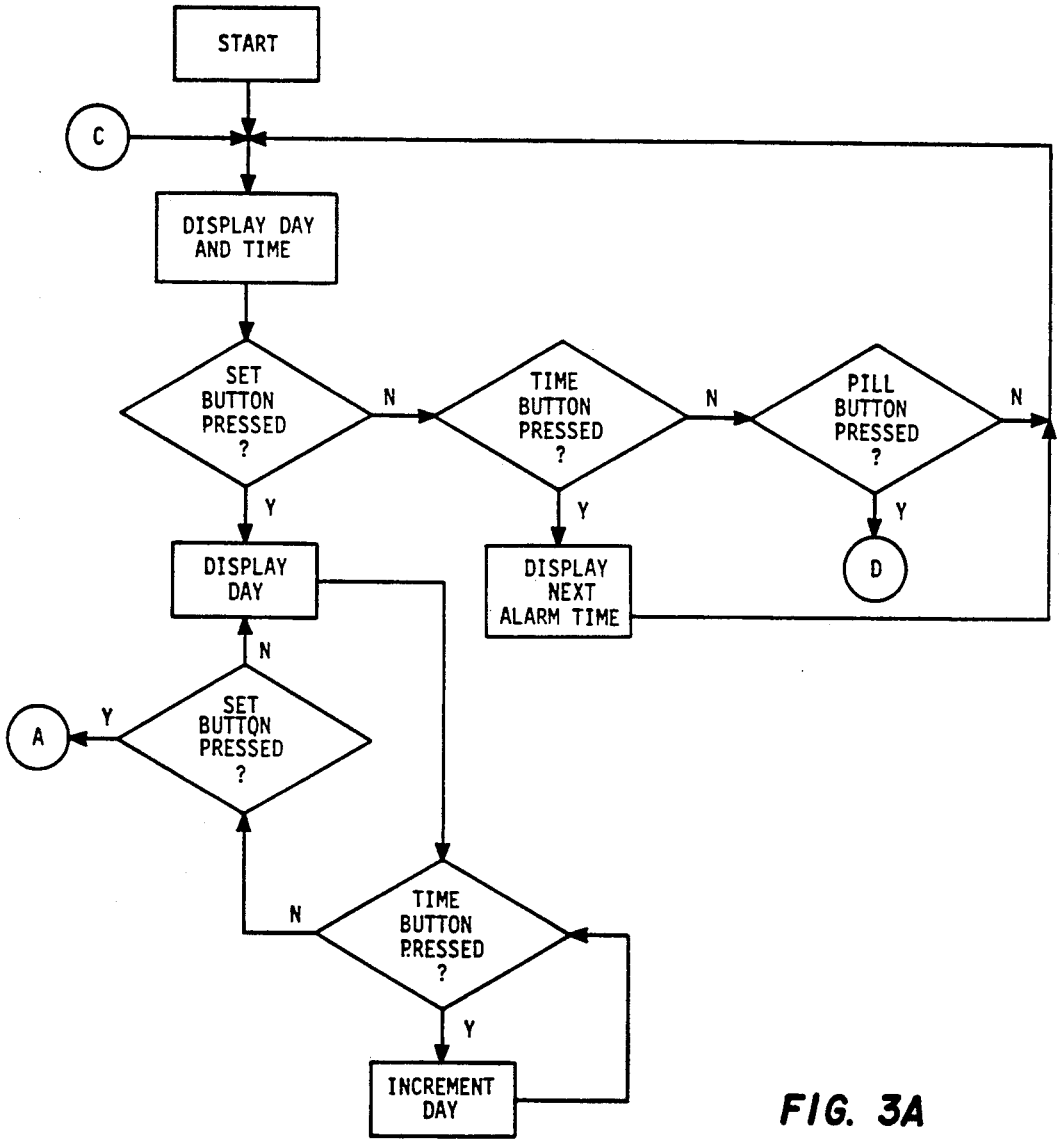
FIGS. 3A-3C are computer flow diagrams, depicting the process by which the apparatus of FIG. 1 is programmed to keep track of day of the week and time of day.
Figure 3B:
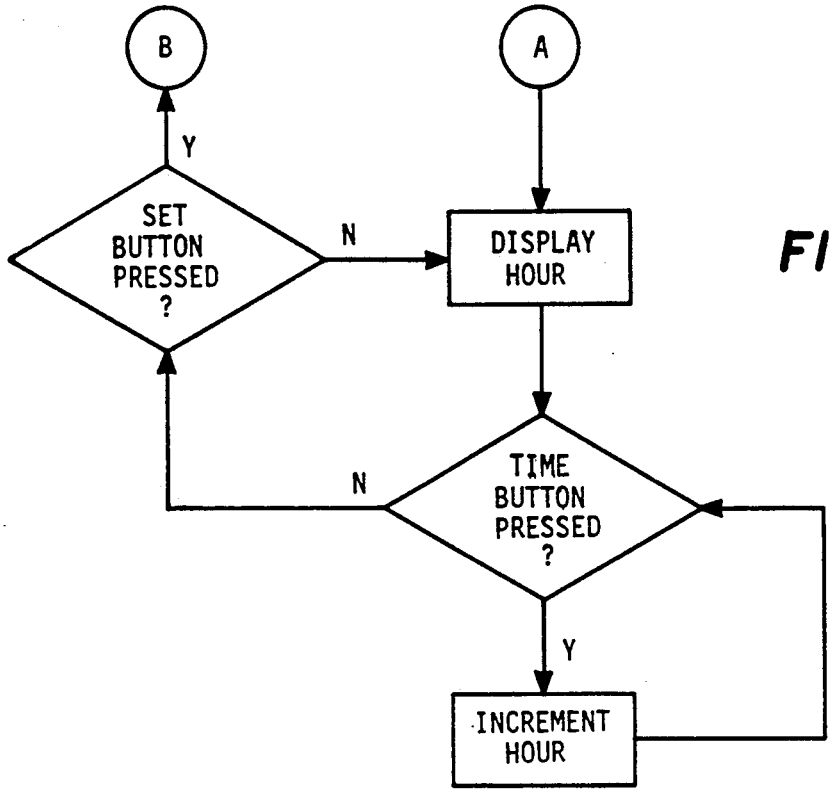
Figure 3C:
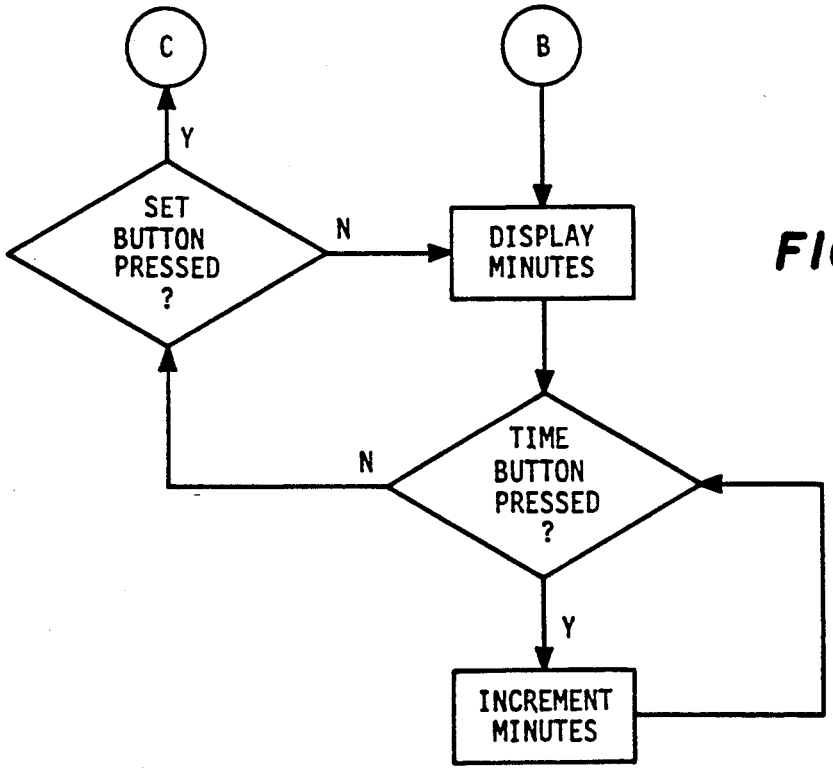

Referring to FIG. 1 and to FIGS. 3A-3C, apparatus 10 is programmed to keep track of the day of the week and time of day in substantially the same manner as a conventional digital timepiece. Referring specifically to FIG. 3A, when the battery power supply is installed in apparatus 10, display 16 will indicate Sunday ("SU"), 12:00. The actual day of the week and time of day is programmed by pressing set button 22 to enter a programming mode for inputting time information. When set button 22 is pressed, the day indicator ("SU") will appear on display 16. To change the day, time button 24 is pressed a number of times equal to the number of increments by which the day is to be changed. For example, if the actual day of the week is Wednesday, time button 24 is pressed three times, to increment the day indicator from Sunday to Wednesday (i.e., from the first day of the week to the fourth day of the week).

When set button 22 is pressed a second time, the current hour will be displayed, as depicted in FIG. 3B. The hour can be changed by pressing time button 24 a number of times equal to the number of increments by which the hour is to be changed. For example, if the current hour is displayed as "12" and one wishes to change the hour to "11", time button 24 must be pressed twelve times to increment the hour from "12" to "11".

Pressing set button 22 a third time will display the current minutes from "00" to "59", as depicted in FIG.

3C. The minutes are changed by incrementing time button 24 a number of times equal to the number of increments by which the minutes are to be changed. A fourth press of set button 22 will display the newly programmed day of the week and time of day and apparatus 10 will return to a normal operating mode, as indicated in FIG. 3A.

Apparatus 10 is programmable for a predetermined number of events (e.g., a predetermined number of different pills or medications) and a predetermined number of alarm times representing the times at which the events are scheduled to occur (e.g., the prescribed times for the various pills or medications). By way of example, apparatus 10 will be described with reference to four different medications and twenty total alarm times. However, one skilled in the art will appreciate that apparatus 10 can be programmed for greater numbers of events and alarm times by increasing the data storage capacity of apparatus 10.

If the user desires to be reminded of when the next medication is due, he need only press time button 24 while apparatus 10 is in the normal operating mode, as shown in FIG. 3A. If no alarm times have been programmed, the word "OFF" will appear on display 16. Otherwise, the next alarm time will be displayed, together with an indication of the medication which is due to be taken at that time. In an alternate embodiment, apparatus 10 can be programmed to display each event and its scheduled time in chronological sequence in response to each press of time button 24.

Figure 4A:
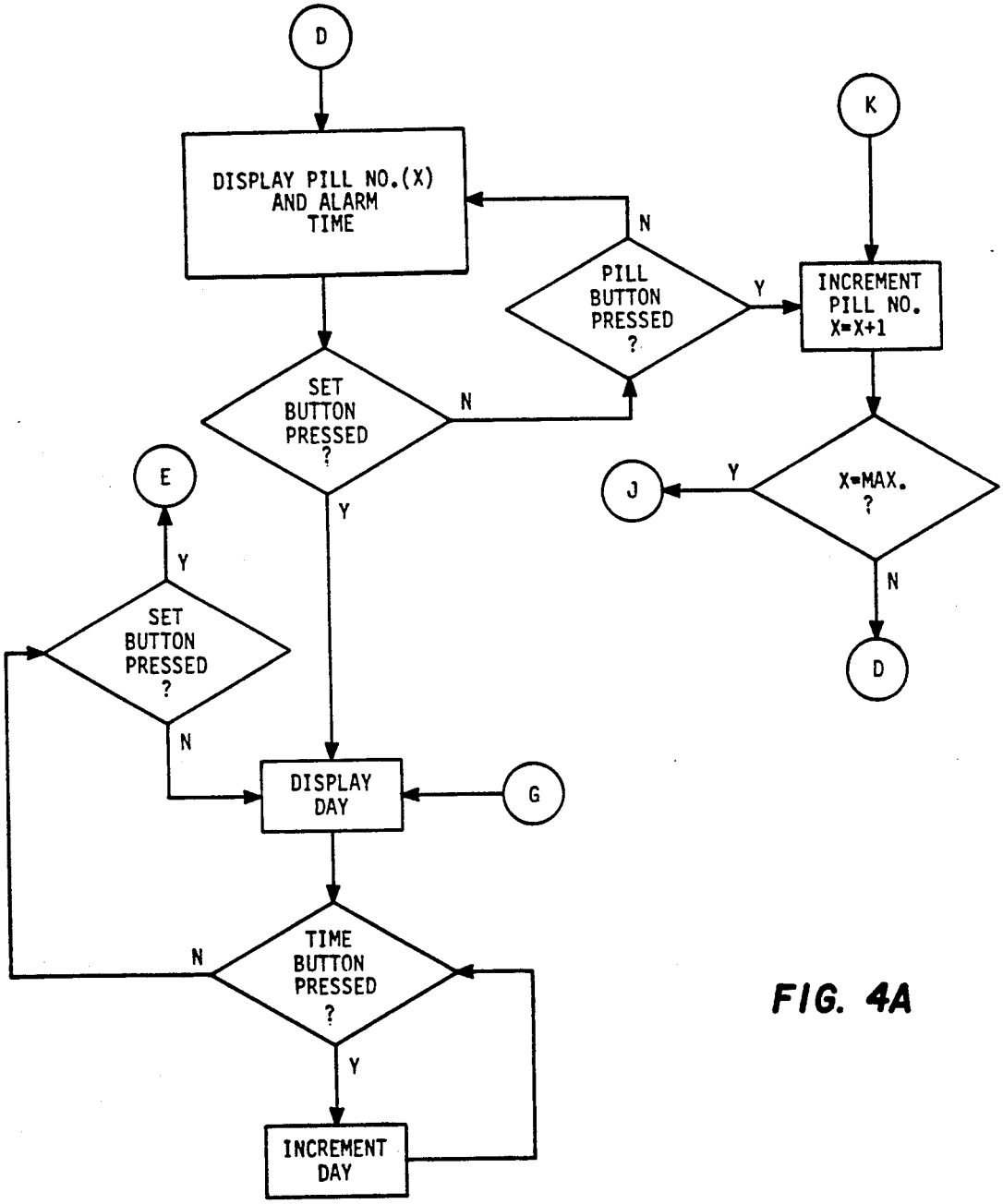
FIGS. 4A-4C are computer flow diagrams, depicting the process by which the apparatus of FIG. 1 is programmed is to keep track of the various times at which medication is due to be taken.
Figure 4B:
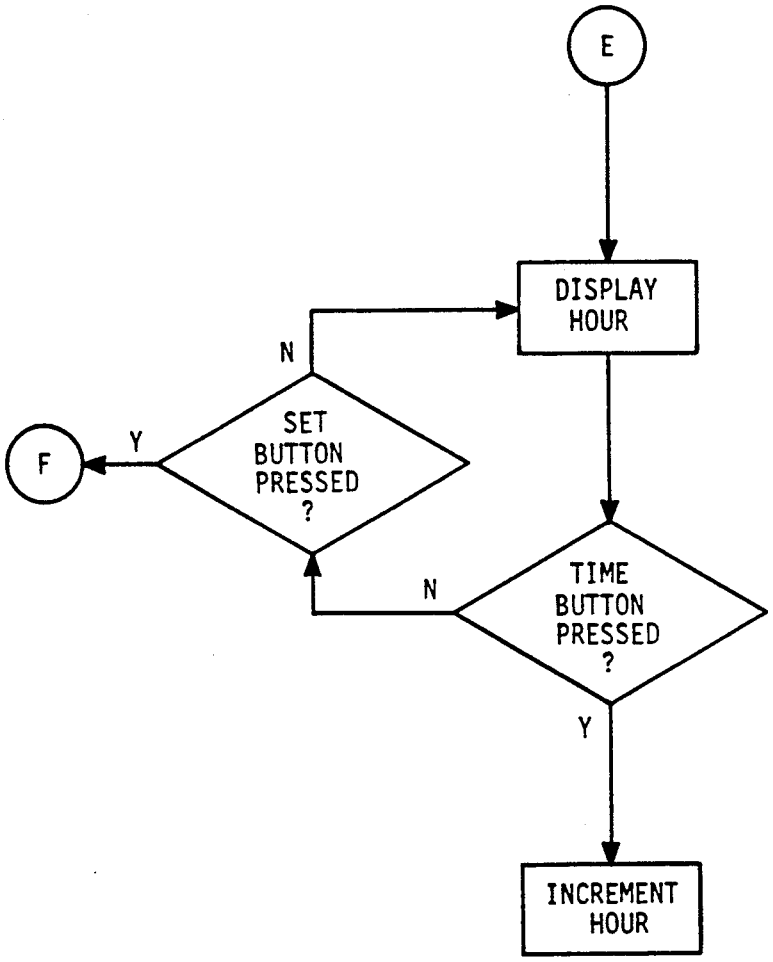
Figure 4C:
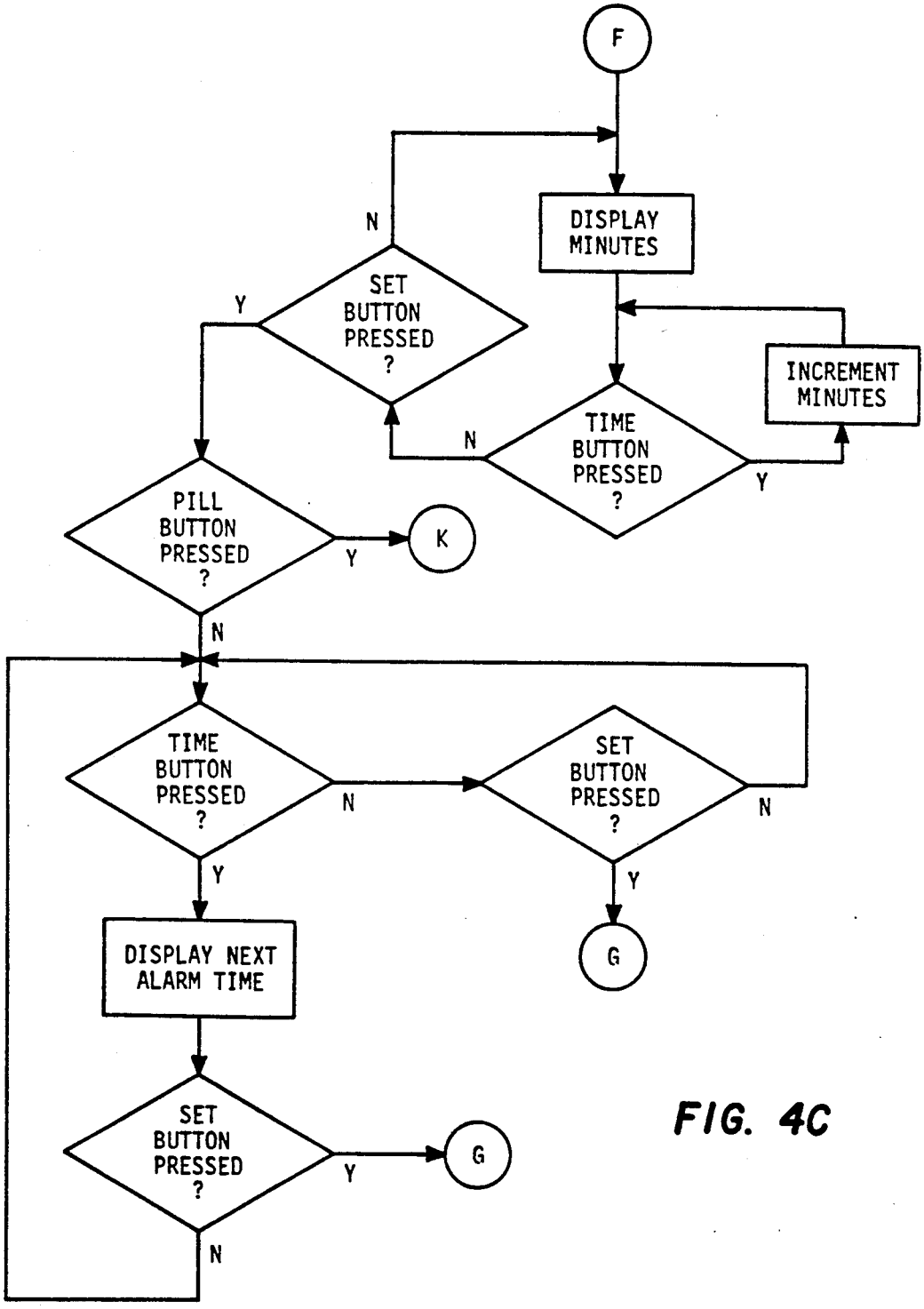

As depicted in FIG. 3A, apparatus 10 will remain in the normal operating mode until pill button 20 is pressed. Pressing pill button 20 will display the pill indicator (i.e., the particular pill number "X") and the time at which that particular pill is to be taken (i.e., the "alarm time"). Pressing pill button 20 causes apparatus 10 to enter another programming mode, whereby alarm times can be programmed, as depicted in FIGS. 4A–4C. The alarm times are programmed by means of set button 22 and time button 24 in a similar manner to that described above with reference to FIGS. 3A–3C. When pill button 20 is first pressed, an indicator representing pill 1 (e.g., "P1") and the first alarm time already programmed for pill 1 will appear on display 16. The alarm time will include both the day and time of day (e.g., "M" for Monday and "12:00 PM", as shown in FIG. 1). If no alarm times have been entered for pill 1, the word "OFF" will appear on display 16.

An alarm time can be entered by pressing set button 22. If no alarm times have previously been entered for pill 1, "0:00" will appear on display 16, which indicates that an alarm time is being entered into an empty memory location corresponding to pill 1. The alarm time, including the day and time of day, is entered using set button 22 and time button 24, as depicted in FIGS. 4A–4C.

After the first alarm time has been entered for pill 1, a second alarm time can be entered by pressing time button 24, whereupon the second alarm time previously programmed into apparatus 10 will be displayed, as depicted in FIG. 4C. If no second alarm time has been previously programmed, "0:00" will appear on display 16, which indicates that the memory location corresponding to the second alarm time for pill 1 is empty. The second alarm time is then entered using set button 22 and time button 24, as depicted in FIGS. 4A–4C. The procedure described above is used to input additional alarm times for pill 1. The maximum number of alarm times which can be programmed for pill 1 is equal to the maximum total number of alarm times which can be stored in apparatus 10, (e.g., 20 total alarm times) minus the total number of alarm times which have already been programmed for the other pill numbers.

After the alarm times for pill 1 have been programmed, pill button 20 is pressed a second time, whereupon an indicator representing pill 2 (e.g., "P2") is displayed along with the first alarm time programmed for pill 2. If no alarm times have been programmed for pill 2, "OFF" will appear on display 16. The alarm times for pill 2 are programmed in the same manner as described above with reference to pill 1. After the alarm times for pill 2 have been programmed, pill button 20 is pressed a third time to display the pill 3 indicator (e.g., "P3") and the desired alarm times are entered for pill 3 in the manner described above. Pill button 20 is then pressed a fourth time to display the pill 4 indicator (e.g., "P4") and to program the alarm times for pill 4.

Figure 5:
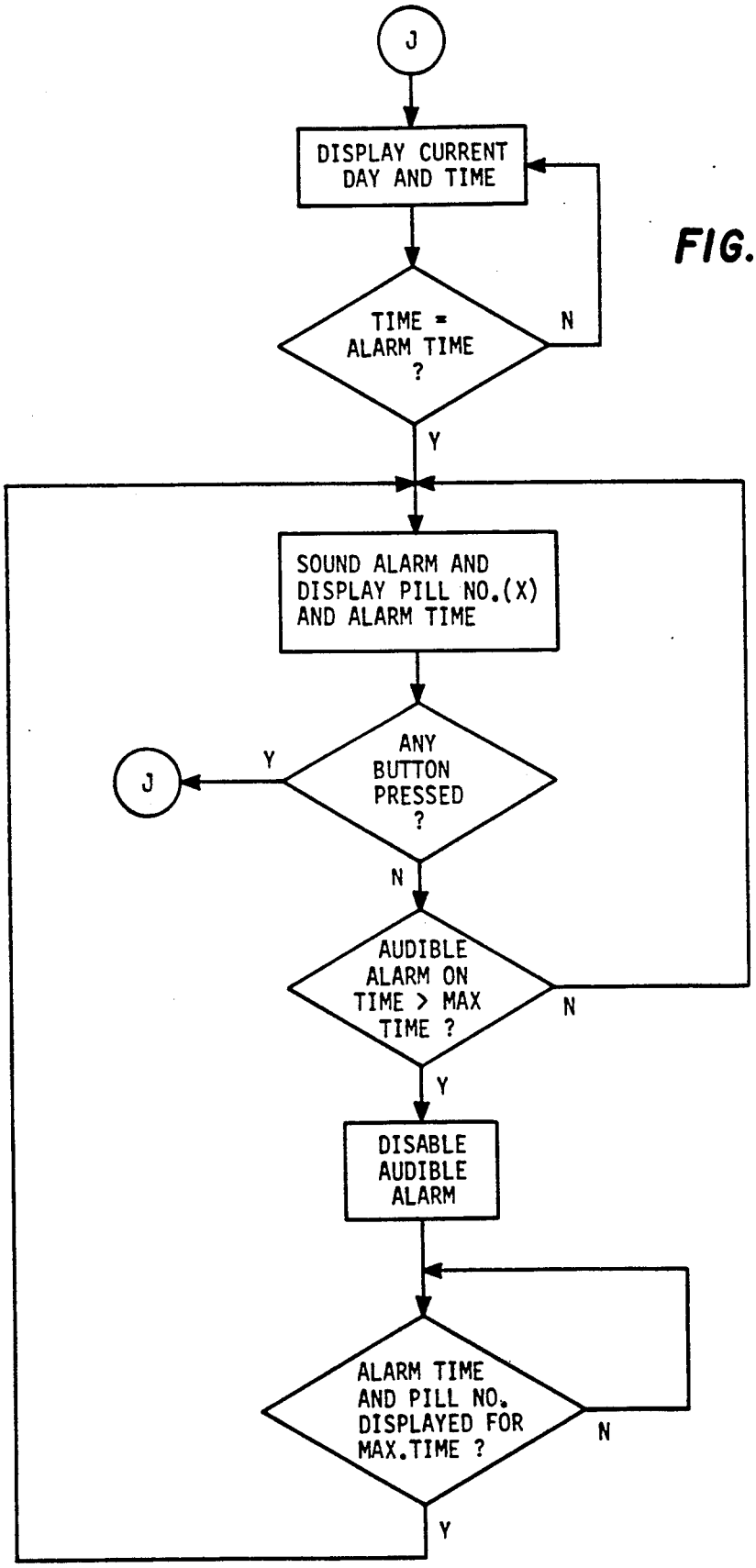
FIG. 5 is a computer flow diagram, depicting the process by which the apparatus of FIG. 1 prompts the user to take particular medication at the prescribed times.

After all of the alarm times for the different medications (pills) have been programmed, apparatus 10 is returned to the normal operating mode by pressing pill button 20 one more time. The current day and time of day are then displayed, as indicated in FIG. 5. If it is desired to erase any of the programmed alarm times, apparatus 10 is returned to the alarm time programming mode and the particular alarm time in question is erased by incrementing the hours and minutes corresponding to that alarm time to read "0:00".

Referring to FIG. 5, apparatus 10 will keep track of the current day and time and will continually compare the current day and time with the programmed alarm times. When the current day and time correspond to any of the programmed alarm times, transducer 18 will be activated to emit an audible alarm for approximately two minutes, while the pill number indicator and the alarm time will flash on and off on display 16 until one of the buttons 20, 22 or 24 is pressed. If one of the buttons 20, 22 or 24 is pressed, both the audible and visual alarms are disabled and the pill number will flash on and off on display 16 for approximately eight seconds, after which the current day and time will re-appear on display 16. Because the user must take affirmative action to disable the current alarm, the user should always be alerted when the prescribed time for his medication has arrived. After the audible alarm has sounded continuously for two minutes, it will be automatically disabled for approximately 28 minutes, such that the audible alarm will be sounded for a period of approximately two minutes, every 30 minutes, or until one of the buttons 20, 22 or 24 is pressed to disable the alarm. After the audible alarm is disabled the pill number indicator and the corresponding alarm time will continue to flash on display 16 until one of the buttons 20, 22 or 24 is pressed to disable the visual alarm.

In accordance with one feature of the invention, the alarms corresponding to the medication which is scheduled to be taken subsequently on that particular day will be at least temporarily disabled until the current alarm signal is disabled, so that apparatus 10 will not prompt the user to take subsequent medications if the user has not acknowledged the current alarm signal by pressing one of the buttons 20, 22 or 24. It is assumed that the current medication has not been taken if the current alarm signal has not been disabled by the user. The sequence in which medication is prescribed is often critical, not only in terms of the effectiveness of the medication, but also because of the side effects which may be produced by the medication. On the other hand, if there is an excessive delay in taking the medication, it may be best to skip that particular medication and wait for the next time that the medication is due. Accordingly, at midnight, every twenty-four hours, apparatus 10 will erase the alarm times corresponding to the pills not taken during the previous day and will begin each new twenty-four period anew. For example, if pill 3 were scheduled to be taken at 2:00 PM on Monday, but the 2:00 PM alarm was never turned off, the 2:00 PM alarm signal will continue until midnight that night, at which time the alarm signal will be automatically disabled and all alarm times programmed for after 2:00 PM on that particular Monday will be erased.

The event reminder apparatus according to the present invention can be quickly and conveniently programmed by the user for multiple events and multiple scheduled times. One or more events can be programmed for multiple times and the apparatus will continually keep track of time to alert the user when each of the programmed events is scheduled to occur. The apparatus is particularly well-suited for keeping track of the times at which medication is scheduled to be administered and will continue to alert the user that a particular medication is overdue until the user takes affirmative action to disable the alarm. The apparatus 10 therefore helps the user maintain the proper sequence of medication by continuing to prompt the user until the alarm corresponding to the current medication is disabled.

Various embodiments of the invention have now been described in detail. Since it is obvious that many changes in and additions to the above-described preferred embodiment may be made without departing from the nature, spirit and scope of the invention, the invention is not to be limited to said details, except as set forth in the appended claims.

We claim:

1. A programmable event reminder apparatus, comprising in combination:

user-controllable input means for entering selected parameters corresponding to a plurality of discrete events into said apparatus, said selected parameters including an event parameter identifying each event and a time parameter indicating a preset elapsed time relative to a predetermined reference time at which each event is scheduled to occur;

memory means for storing said selected parameters;

timekeeping means for measuring elapsed time relative to the predetermined reference time;

alarm means for generating a discrete alarm signal for each event, each discrete alarm signal identifying a corresponding event and the preset elapsed time relative to the predetermined reference time at which the corresponding event is scheduled to occur;

control means responsive to said selected parameters and elapsed time measured by said timekeeping means for controlling said alarm means to generate a particular discrete alarm signal when the measured elapsed time corresponds to the preset elapsed time of a particular event;

user-controllable means for disabling said alarm means from generating said particular discrete alarm signal; and means for automatically disabling said alarm means from generating the discrete alarm signals corresponding to selected events which are scheduled to occur after the particular event until said particular discrete alarm signal is disabled by said user-controllable means.

2. The apparatus of claim 1 wherein said time parameter represents a predetermined clock time, said timekeeping means for keeping track of the current time of day on a twenty-four hour basis.

3. The apparatus of claim 2 wherein said time parameter represents a particular day of the week and a particular time of day, said timekeeping means for keeping track of the current day of the week and time of day.

4. The apparatus of claim 1 wherein said event represents particular medication to be taken by a user.

5. The apparatus of claim 1 further including display means for providing a visual indication of the particular event and the preset elapsed time at which the event is scheduled to occur when said particular discrete alarm signal is generated.

6. The apparatus of claim 1 wherein said input means includes switch means for selecting a mode of operation of said apparatus, said apparatus having a programming mode in which said selected parameters are entered into said apparatus and an operating mode in which said apparatus is responsive to said selected parameters for reminding a user when each event is scheduled to occur.

7. The apparatus of claim 6 further including usercontrollable switch means for controlling the apparatus to identify the next scheduled event and the time parameter corresponding thereto when the apparatus is in the operating mode.

8. The apparatus of claim 6 further including means for storing the events in chronological sequence and means for indicating to the user the time parameter corresponding to each event in chronological sequence when the apparatus is in the programming mode.

9. The apparatus of claim 1 wherein said selected events correspond to the events scheduled to occur after the particular event during a particular twenty-four hour day, said means for automatically disabling said alarm means permanently disabling said alarm means from generating the discrete alarm signal for each event scheduled during a particular twenty-four hour period for which the corresponding discrete alarm signal is not generated during that particular twenty-four hour period.

10. The apparatus of claim 1 wherein each discrete alarm signal includes an audible signal and a visual signal identifying the corresponding event and the time parameter of the corresponding event; said audible signal being generated intermittently until said alarm signal is disabled, said visual signal being generated continuously until said alarm signal is disabled.

11. The apparatus of claim 1 wherein the time parameter corresponding to each event indicates the time of day at which the corresponding event is scheduled to occur.

* * * * *